US007665727B2

(12) United States Patent
Berger et al.

(10) Patent No.: US 7,665,727 B2
(45) Date of Patent: Feb. 23, 2010

(54) ENCLOSED CARTON MAGAZINE ASSEMBLY

(75) Inventors: Gerald Paul Berger, Cedar Rapids, IA (US); Cletus Emerich Kreher, Marion, IA (US); Yasushi Sasaki, Fukuoka (JP); Toshiyuki Kanemaru, Tokyo (JP)

(73) Assignee: Evergreen Packaging Inc., Memphis, TN (US)

( * ) Notice: Subject to any disclaimer, the term of this patent is extended or adjusted under 35 U.S.C. 154(b) by 392 days.

(21) Appl. No.: 11/304,832

(22) Filed: Dec. 15, 2005

(65) Prior Publication Data

US 2007/0138735 A1 Jun. 21, 2007

(51) Int. Cl.
*B65H 1/00* (2006.01)

(52) U.S. Cl. ..... 271/162; 271/105; 271/211; 271/145; 271/90

(58) Field of Classification Search ..... 271/105, 271/145, 211, 162; 414/291, 292, 795.4
See application file for complete search history.

(56) References Cited

U.S. PATENT DOCUMENTS 3,891,205 A * 6/1975 Sunahara et al. ..... 271/98
4,590,731 A 5/1986 DeGooyer
4,590,740 A 5/1986 Rodocker
4,684,021 A * 8/1987 Niebling et al. ..... 206/711
4,963,335 A 10/1990 Adachi et al.
5,097,649 A 3/1992 Ueda et al.
5,122,340 A * 6/1992 Shimamura et al. ..... 422/28
5,217,053 A * 6/1993 Foster et al. ..... 141/98
5,398,922 A * 3/1995 Malatesta ..... 271/11
5,478,066 A * 12/1995 Yoshida et al. ..... 271/12
5,570,987 A * 11/1996 McKenna ..... 414/416.01
5,586,585 A * 12/1996 Bonora et al. ..... 141/93
5,636,961 A * 6/1997 Ohta ..... 414/411
6,056,918 A 5/2000 Palaniappan et al.
6,058,678 A 5/2000 Lees (Continued)

FOREIGN PATENT DOCUMENTS

DE 19630376 2/1998

(Continued)

OTHER PUBLICATIONS

Webster's New Basic Dictionary, © 2007, 2005 by Houghton Mifflin Company, p. 487.*

(Continued)

*Primary Examiner*—Patrick H Mackey
*Assistant Examiner*—Prasad V Gokhale
(74) *Attorney, Agent, or Firm*—Perkins Coie LLP

(57) ABSTRACT

A system, method, and process of for packaging liquid product into cartons using an automated packaging system and more specifically methods of enclosing the packaging system and routing conditioned air over the cartons is presented. More specifically, a carton magazine assembly for collecting plastic coated paper carton blanks prior to sanitization, assembly, filling, and sealing includes a magazine cover that can be opened to insert additional carton blanks into the packaging system as necessary. The magazine cover has an integrated air manifold that directs pressurized conditioned air over the carton blanks towards suction ports. The suction ports collect the air with potential contaminants and the filters the air prior to ejecting it away from the vicinity of the packaging system.

19 Claims, 7 Drawing Sheets

U.S. PATENT DOCUMENTS

| | | | | |
|---|---|---|---|---|
| 6,082,728 | A * | 7/2000 | Ubayashi | 271/108 |
| 6,094,887 | A | 8/2000 | Swank et al. | |
| 6,158,083 | A * | 12/2000 | Holsten | 15/326 |
| 6,183,691 | B1 | 2/2001 | Swank et al. | |
| 6,386,658 | B1 | 5/2002 | Dietrich et al. | |
| 6,398,208 | B1 * | 6/2002 | Yang et al. | 271/107 |
| 6,450,493 | B1 * | 9/2002 | Milillo et al. | 271/11 |
| 6,554,269 | B1 * | 4/2003 | Dobbertin et al. | 271/90 |
| 6,702,275 | B2 * | 3/2004 | Niiyama et al. | 271/98 |
| 6,918,581 | B2 * | 7/2005 | Horiuchi | 271/96 |
| 7,370,764 | B2 * | 5/2008 | Nyseth et al. | 206/711 |
| 2004/0041333 | A1 * | 3/2004 | Izumi et al. | 271/145 |
| 2004/0088817 | A1 * | 5/2004 | Cochran et al. | 15/327.5 |
| 2005/0046229 | A1 * | 3/2005 | Yamada et al. | 296/146.8 |

FOREIGN PATENT DOCUMENTS

| | | |
|---|---|---|
| EP | 0454260 | 3/1994 |
| EP | 1607333 | 12/2005 |
| FR | 2818615 | 6/2002 |
| GB | 1442751 | 7/1976 |

OTHER PUBLICATIONS

The International Preliminary Report on Patentability (IPRP), mailed Jun. 26, 2008, Int'l Application No. PCT/US/2006/046635, filed Dec. 6, 2006 (6 pages) and pending claims of the PCT application (3pages).

* cited by examiner

ENCLOSED CARTON MAGAZINE ASSEMBLY

TECHNICAL FIELD

The present invention relates to a device, method, and system for packaging liquid product into containers using an automated packaging system and more specifically to methods of enclosing the packaging system and routing air through the packaging system to reduce contamination.

BACKGROUND

Automated packaging systems for food products that use paper cartons can be highly automated machines to automatically package food or other liquid products. In the case of paper cartons, the packaging system can automatically assemble the carton container from a paper blank and seal the bottom of the blank to ready it to receive the product. Then the packaging system automatically fills the container with product and seals the top of the container. When the container emerges from the packaging system it is filled, sealed, and ready for delivery.

A particular concern for packaging systems is the need to minimize potential sources of contamination. These sources of contamination can come from external sources such as dripping fluid from overhead condensate, dust from the environment, accidental spray, and dust from the packaging materials. In the case of cartons made from plastic (polymer) coated paper for example, contamination by dust from the packaging is a particular concern since the plastic coated paper blanks (hereinafter carton blanks) are typically cut with high speed cutting machinery. The cutting process generates significant levels of dust which remain on the carton blanks even when they are loaded in the machine. The management and control of these sources of contamination is important because contamination can reduce the shelf life of a packaged product.

Therefore, there is a need for a method, apparatus, and process to control contamination in packaging systems and more particularly to control contamination originating from carton blanks and carton magazines on packaging systems.

BRIEF DESCRIPTION OF THE DRAWINGS

The accompanying figures depict multiple embodiments of a carton magazine and air filtration system for operating a packaging system and minimizing contaminates in a product packaging system. A brief description of each figure is provided below. Elements with the same reference numbers in each figure indicate identical or functionally similar elements. Additionally, the left-most digit(s) of a reference number identifies the drawings in which the reference number first appears.

DETAILED DESCRIPTION

Figure 1:
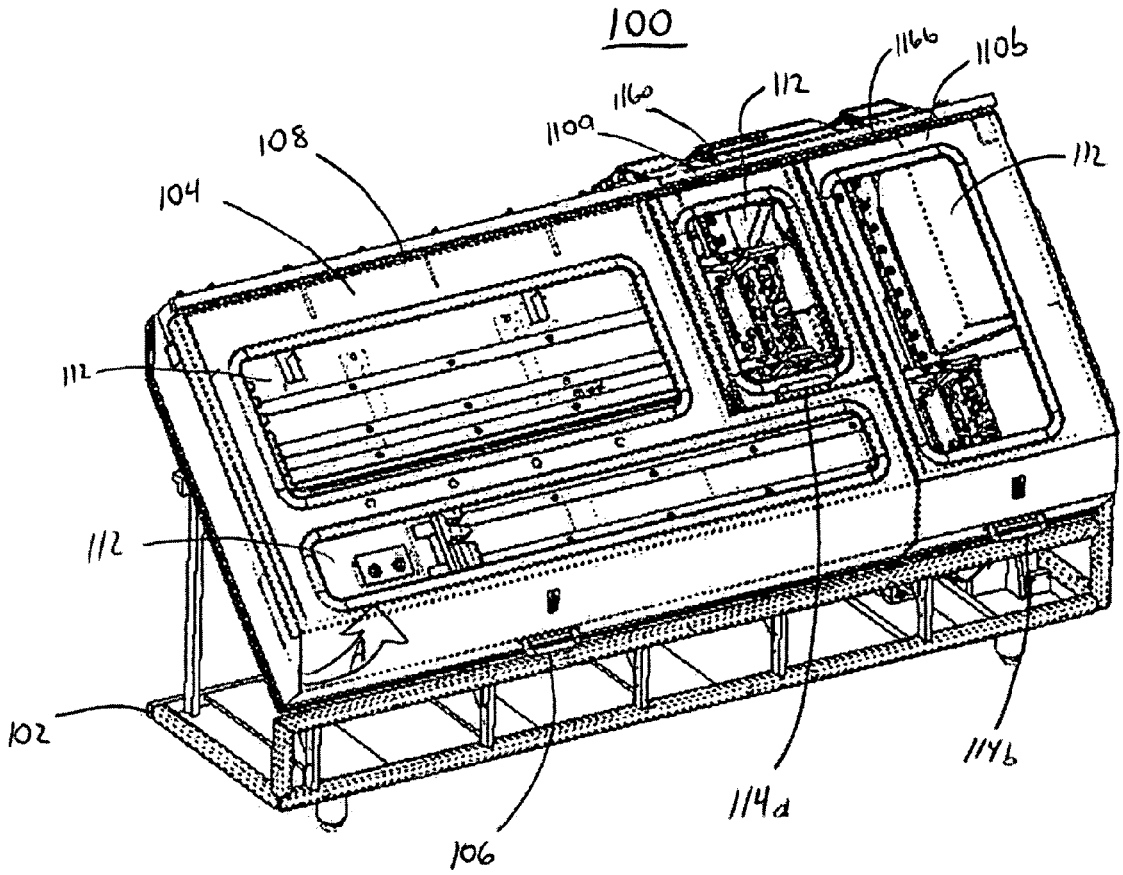
FIG. 1—is an isometric view of one embodiment of a carton magazine assembly with cover closed.

FIG. 1 shows an isometric view of a carton magazine assembly 100. The carton magazine assembly 100 is mounted on a support frame 102. The magazine cover 104 covers and encloses the carton magazines 204 that hold the carton blanks. This embodiment of the magazine cover 104 has a hinge 108 near the upper edge of the magazine cover 104 to rotatably attach the magazine cover 104 to the carton magazine assembly 100. The hinge 108 enables the magazine cover 104 to be swung in the direction A into an open position, thereby enabling a machine operator or automated loading machine access to the carton magazines 204. With the magazine cover 104 open, a machine operator or automated loading machine can insert additional carton blanks into the carton magazine assembly 100 while packaging system 700 continues to operate. In this embodiment, the magazine cover 104 is adapted for a human operator and has a handle 106 that the operator (not shown) may grasp to open and close the magazine cover 104. The magazine cover 104 has, in this embodiment two viewing windows 112 to enable an operator to visually inspect the status of the carton magazines 204 even when the magazine cover 104 is closed. The magazine cover 104 in this embodiment also has a sealing ring arrayed around the periphery of the cover to provide for both soft closure and to seal the interior of the carton magazine assembly 100 from the environment. Due to the positive air pressure inside the carton magazine assembly 100 when the magazine cover 104 is closed, the sealing ring does not have to be air tight in order to reduce potential contamination. In an alternative embodiment the sealing ring is a set of elastomer grommets or feet that primarily provide soft closure for the magazine cover 104.

The carton magazine assembly 100 also has two blank opening covers 110*a* and 110*b*. Each blank opening cover has a blank opening hinge 116*a* and 116*b*. The blank opening covers 110 also have a respective blank opening handle 114*a* and 114*b* for a human operator may grasp and open and close the blank opening covers 110. The blank opening covers 110 also have viewing windows 112. The viewing windows 112 enable an operator to visually inspect the operation of the equipment.

Figure 2:
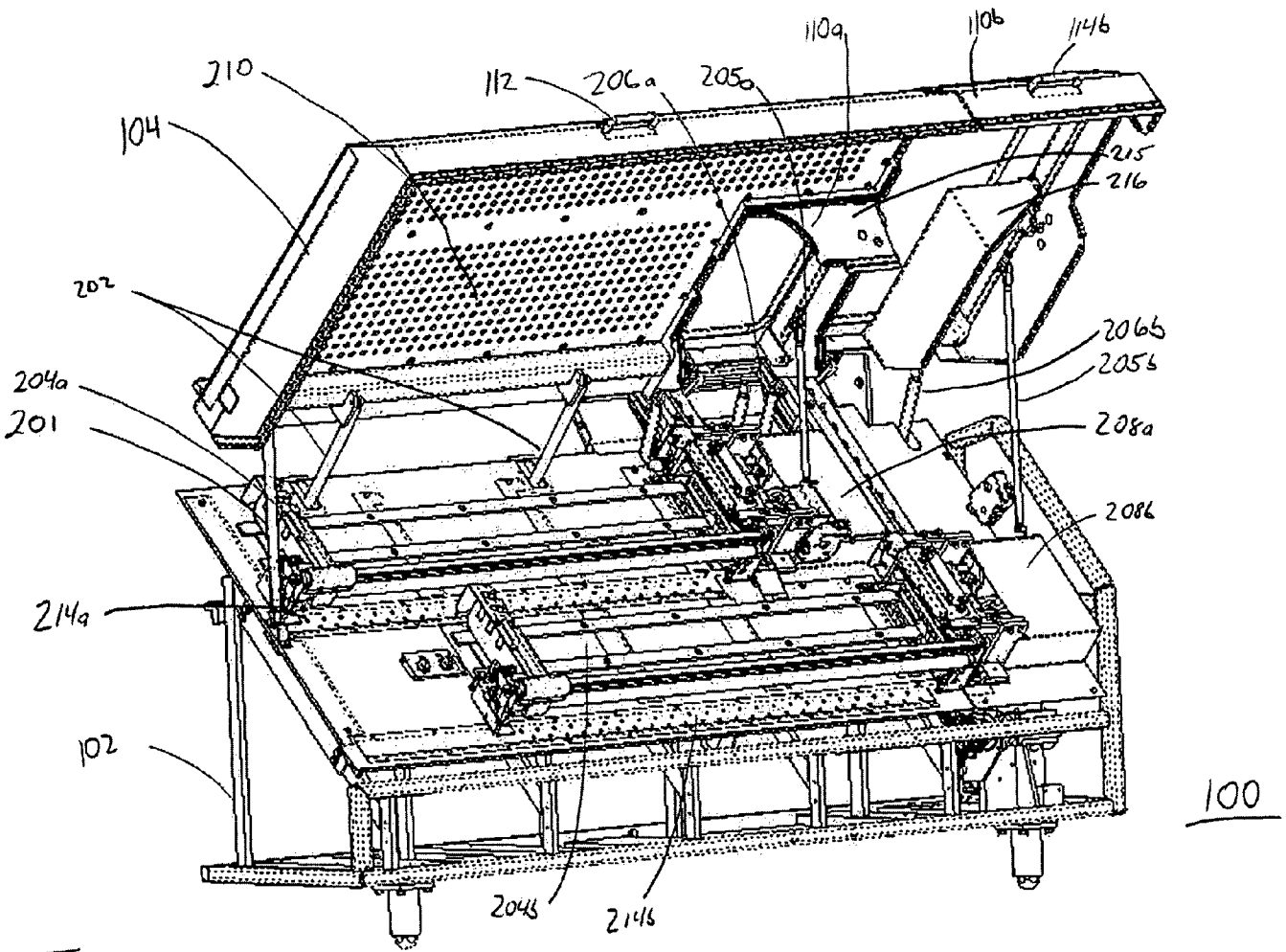
FIG. 2—is an isometric view of one embodiment of a carton magazine assembly with cover open.

Referring now to FIG. 2, the carton magazine assembly 100 is shown with the magazine cover 104, and the blank opening covers 110 open. The magazine cover 104 has a magazine cover air spring 202 that assists in the opening of the magazine cover 104 and substantially prevents the magazine cover 104 from slamming downward with excessive energy. Each of the blank opening covers 110 also has respective blank opening cover air springs 206*a* and 206*b* that assist an operator in lifting the attached blank opening covers 110 and substantially prevents the blank opening covers 110 from slamming downward with excessive energy. Alternative embodiments of the air springs 202 and 206 may include, but are not limited to hydraulic springs, electro-magnetic linear actuator/damper, electro-rheologic dampers. In yet other embodiments, the air springs 202 and 206 are fully actuated devices, such as a ball-screw, hydraulic, pneumatic, or electromagnetic actuators to fully automate the opening and closing of the magazine cover 104 and the blank opening covers 110.

In addition to the magazine cover air spring 202 and the blank opening cover air springs 206*a* and 206*b* there are additional safety features to hold the magazine cover 104 and the blank opening covers 110 in the open position. Specifically, a magazine cover prop rod 201 is shown to provide an additional means for holding the magazine cover 104 in the open position. Similarly, there are blank opening prop rods 205*a* and 205*b* that provide additional means for holding the blank opening covers 110*a* and 110*b* in the open position. The magazine cover prop rod 201 and the blank opening cover prop rods 205 in this embodiment supplement the air springs 202 and 206 to provide additional protection to prevent the magazine cover 104 and blank opening covers 110 from inadvertently closing when they are in the open position.

In the embodiment depicted in FIG. 2, the magazine cover 104 and the blank opening covers 110 open far enough to enable access to the interior of the carton magazine assembly 100, but still remaining closed so that a substantial portion of the underlying carton magazine assembly 100 is covered from potential dripping of overhead condensate from overhead piping and equipment into the interior of the carton magazine assembly 100. There are numerous other embodiments of the magazine cover 104 and blank opening covers 110 that permit similar operation. For example, in one alternative embodiment, the magazine cover 104 and the blank opening covers 110 are designed to slide on tracks to expose the underlying equipment. In another alternative embodiment, the viewing windows 112 are hinged to move separately from the remainder of the cover enabling access to the interior of the carton magazine assembly 100. In yet another embodiment, the magazine cover 104 and the blank opening covers 110 are split along the centers and fold open like a clam-shell on hinges mounted on the periphery of the cover to expose the interior of the carton magazine assembly 100.

Inside this embodiment of the carton magazine assembly 100, is an upper carton magazine 204*a* and a lower carton magazine 204*b*. The carton magazines 204 accept a stack of carton blanks (not shown) that are typically plastic coated paper folded into a substantially flat form prior to opening and sealing to create the product containers. The upper carton magazine 204*a* feeds an upper carton opening mechanism 208*a*, while the lower carton magazine 204*b* feeds a lower carton opening mechanism 208*b*. The carton opening mechanisms 208 utilize air and other mechanisms known to those of ordinary skill in the art to separate and open each individual carton blank from the carton magazine 204.

Continuing to refer to FIG. 2, on the inside of the magazine cover 104 is a perforated air cover 210. The perforated air cover 210 is spaced a distance away from the outer panel of the magazine cover 104 creating a magazine cover air manifold 212. The magazine cover air manifold 212 is pressurized with conditioned air that is ejected from the holes in the perforated air cover 210. In the embodiment depicted the conditioned air is microfiltered air from the environment which has substantially all dust particles above a specified size removed from the air stream. In alternative embodiments, the conditioned air also has reduced humidity. In yet another embodiment the conditioned air is another gas such as dry nitrogen from an external source or a combination of conditioned air from the environment and another gas from an external source. Regardless of source, the ejected conditioned air is directed downward onto the carton magazines 204. The purpose of ejecting conditioned air across the carton magazines 204 is to urge dust and particulate matter off the cartons while ensuring there is a constant stream of conditioned air directed over the cartons waiting packaging in the carton magazine 204. Further, the stream of conditioned air substantially prevents the build up of condensate on the interior of the magazine cover 104 or the perforated air cover 210 that might drip on the waiting carton blanks in the carton magazine 204 or being processed in the carton opening mechanisms 208.

The carton magazine assembly 100 has an upper array of magazine suction nozzles 214*a* and a lower array of magazine suction nozzles 214*b*. The magazine suction nozzles 214 draw air from the carton blanks stored in the carton magazines 204. The action of the magazine cover air manifold 212 ejecting conditioned air into the magazine coupled with the magazine suction nozzles 214 creates a flow pattern of conditioned air over the carton blanks. The flow pattern captures packaging dust and other contaminants from the carton and the environment (when the magazine cover 104 is open). The magazine suction nozzles 214 create a low pressure region in their vicinity thereby urging air inside the carton magazine assembly 100 into the magazine suction nozzles 214. The movement of conditioned air into the carton magazine assembly 100 from the magazine cover air manifold 212 then out of the unit through the magazine suction nozzles 214 operates to remove contamination from the carton blanks and the interior of the carton magazine assembly 100. Further, controlling the flow of air within the carton magazine assembly 100 is a carton opening mechanism air baffle 216. The carton opening mechanism air baffle 216 directs air toward the opening mechanism 208*b*.

A blank opening mechanism safety shield 215 is mounted on the blank opening cover 110*a*. The blank opening mechanism safety shield 215 minimizes the potential of an operator inadvertently accessing the blank opening mechanism 208*a* when the magazine cover 104 is open. The blank opening mechanism safety shield 215 also provides secondary control of air flow within the carton magazine assembly 100 by impeding the movement of air from or into the area of the blank opening mechanism 208*a*.

Figure 3:
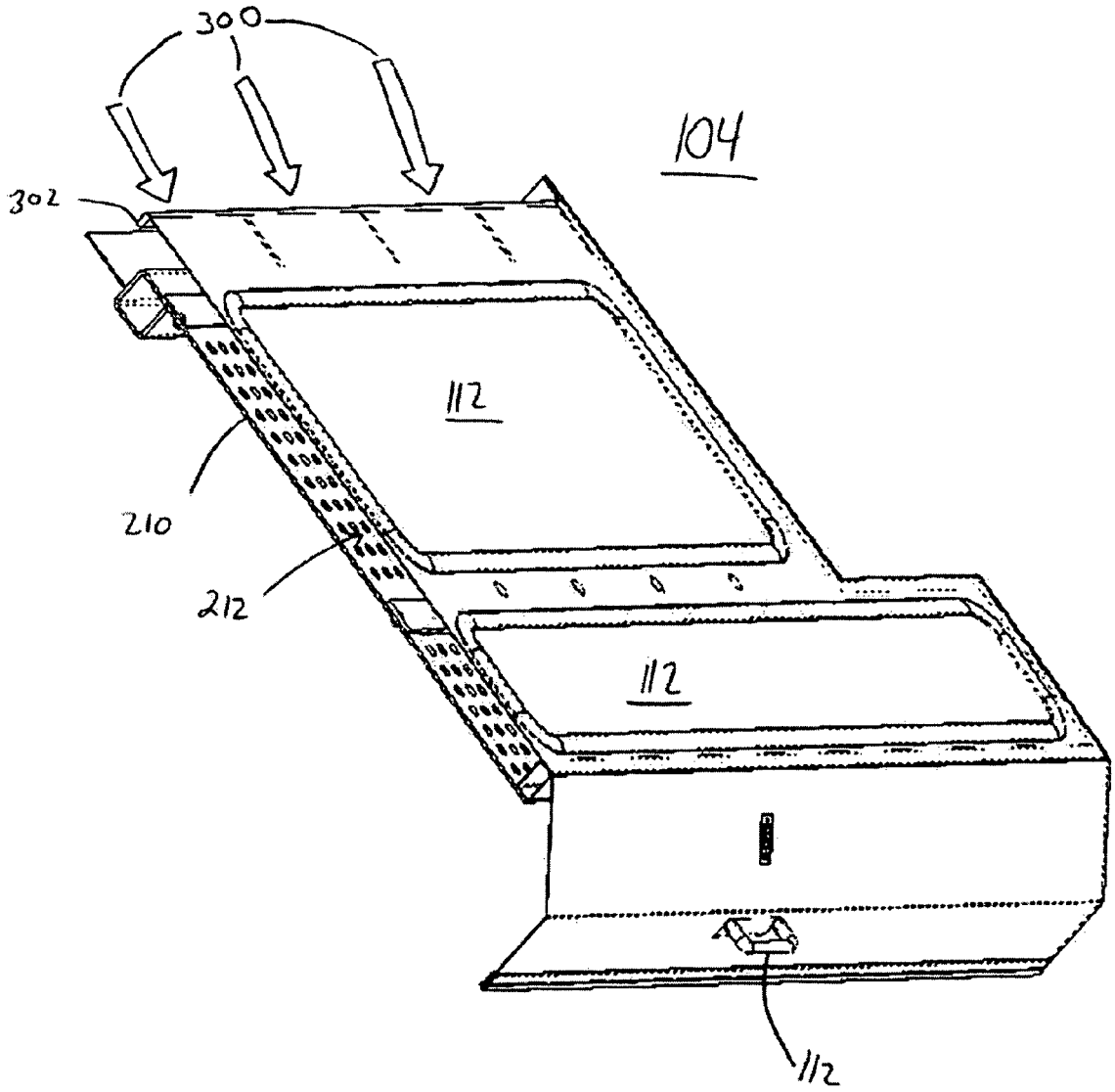
FIG. 3—is an isometric cutaway of one embodiment of the carton magazine cover.

Now referring to FIG. 3, a cutaway isometric view of one embodiment of the magazine cover 104 is shown. The perforated air cover 210 is shown spaced a distance away from the outer magazine cover 104 thereby forming the magazine cover air manifold 212. The magazine cover air manifold 212 is pressurized by conditioned air flowing into the cover 300 through the cover conditioned air inlet 302. The conditioned air inside the cover air manifold 212 is held to a pressure greater than either the ambient atmosphere or the interior of carton magazine assembly 100 to ensure conditioned air flows through the perforated air cover 210. In this embodiment, two viewing windows 112 are shown. In order to maintain visual observation of the interior of the carton magazine assembly 100, the perforated air cover 210 is constructed of a substantially transparent material such as polycarbonate, acrylic (polymethlamethacrylate), PETG (glycol modified polyethylene terphthalate), PVC (polyvinylchloride), PMP (polymethylpenten), polystyrene, or Butyrate (cellulose acetate butyrate). In alternative embodiments, the perforated air cover 210 has sufficiently large and closely spaced holes to enable an operator to view the internal carton magazine assembly 100 with sufficient clarity to discern the activity inside the unit without opening the magazine cover 104 or the blank opening covers 110. In the embodiment depicted, the holes in the perforated air cover 210 are substantially uniform throughout the entire surface. In alternative embodiments, the relative size of the holes vary across the surface from smaller diameter to larger diameter in order to maintain a relatively constant velocity of conditioned air through the perforated air cover 210 regardless of position or proximity of a specific location on the perforated air cover 210 to the cover conditioned air inlet 302. In yet another alternative embodiment, the perforated air cover 210 has rectangular slots instead of holes to direct and control the flow of conditioned air from the magazine cover air manifold 212.

Figure 4:
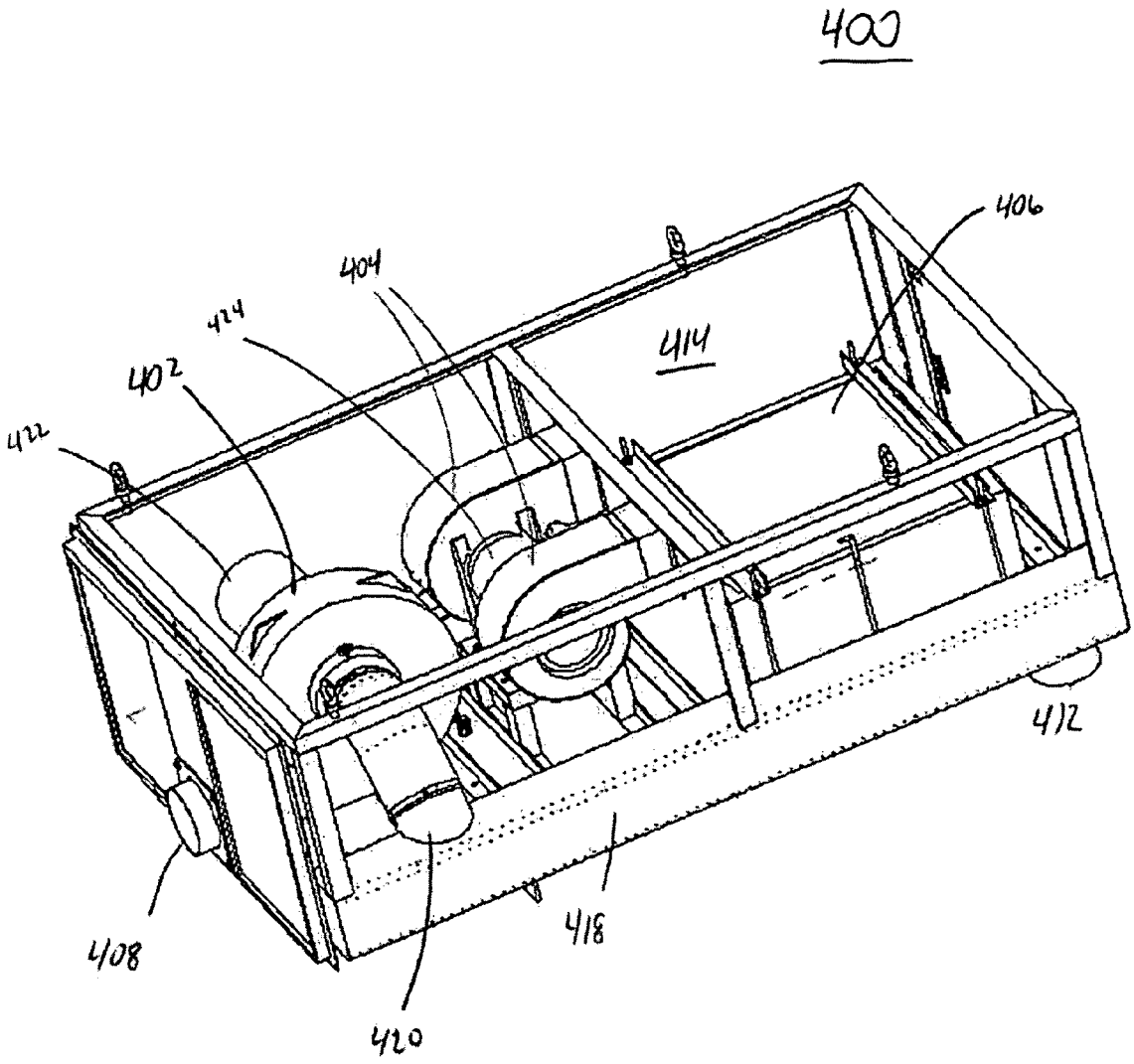
FIG. 4—is an isometric view of the interior of the air filtration unit.

A cutaway isometric view of the air filtration unit 400 is shown in FIG. 4. The air filtration unit 400 provides both suction and pressurized conditioned air for the carton magazine assembly 100. The suction and pressurized conditioned air are used together to reduce contamination inside the carton magazine assembly 100 and to operate various pneumatic operations within the packaging system 700, including but not limited to the carton opening mechanisms 208. The air filtration unit 400 has a single suction blower 402. The suction blower 402 in this embodiment is a centrifugal fan driven by an electric motor 422. The suction blower 402 pulls air from inside the carton magazine assembly 100 and from other areas inside the packaging system 700 through the suction air inlet suction blower inlet 420 coupled with a rectangular suction tube 418 that is in fluid communication with the suction air inlet 412. The suction blower 402 then ejects the air removed from inside the unit through the suction exhaust port 408. The suction exhaust port 408 is plumbed to an area away from any container packaging or storage areas in order to minimize possible contamination of the environment surrounding the packaging system 700.

The air filtration unit 400 also has a pair of air blowers 404. The air blowers 404 pull ambient air surrounding the air filtration unit 400 and the packaging system 700 into the air filtration unit 400. The air blowers 404 in this embodiment are a pair of centrifugal fans driven by a single electric motor 424. The air blowers 404 eject the ambient air into an air conditioning staging volume 414 thereby increasing the pressure of air inside the air conditioning staging volume 414. The pressurized air is forced from the air conditioning staging volume 414 through an air filter 406 into the conditioned air outlet manifold 410. The air conditioning staging volume 414 is exposed in FIG. 4 for clarity; during normal operation the air conditioning staging volume 414 is enclosed. The air conditioning staging volume 414 in some alternative embodiments has an ultraviolet light or ionizing gas source to reduce potential contaminants in the air prior to filtration. In other embodiments, a dehumidifying system is provided to reduce the relative humidity of the air in the air conditioning staging volume 414 prior to filtration. In yet another alternative embodiment the conditioned air supplied by the air filtration unit 400 is air from the ambient environment pressurized by means of the air blowers 404.

The air filter 406 in this embodiment is a microfiltration high-efficiency particulate air (HEPA) filter. A HEPA filter is designed to remove more than 99.97% of all airborne pollutants 0.3 microns or larger at the designed flow rate. After passing through the air filter 406, the conditioned air passing through the conditioned air outlet manifold 410 can be considered micro-filtered air. In other embodiments, the air filter 406 uses other types of filters such as an ultra-low particle air (ULPA) filter or a combination of filters including electrostatic filters.

In yet another alternative embodiment of the air filtration unit 400, the output of the suction blower 402 is plumbed either directly or indirectly into the air blowers 404. The resulting recycled air then passed through air filter 406 and any additional conditioning prior to exiting the air filtration unit 400 through the conditioned air outlet manifold 410 and being sent to the carton magazine assembly 100.

Figure 5:
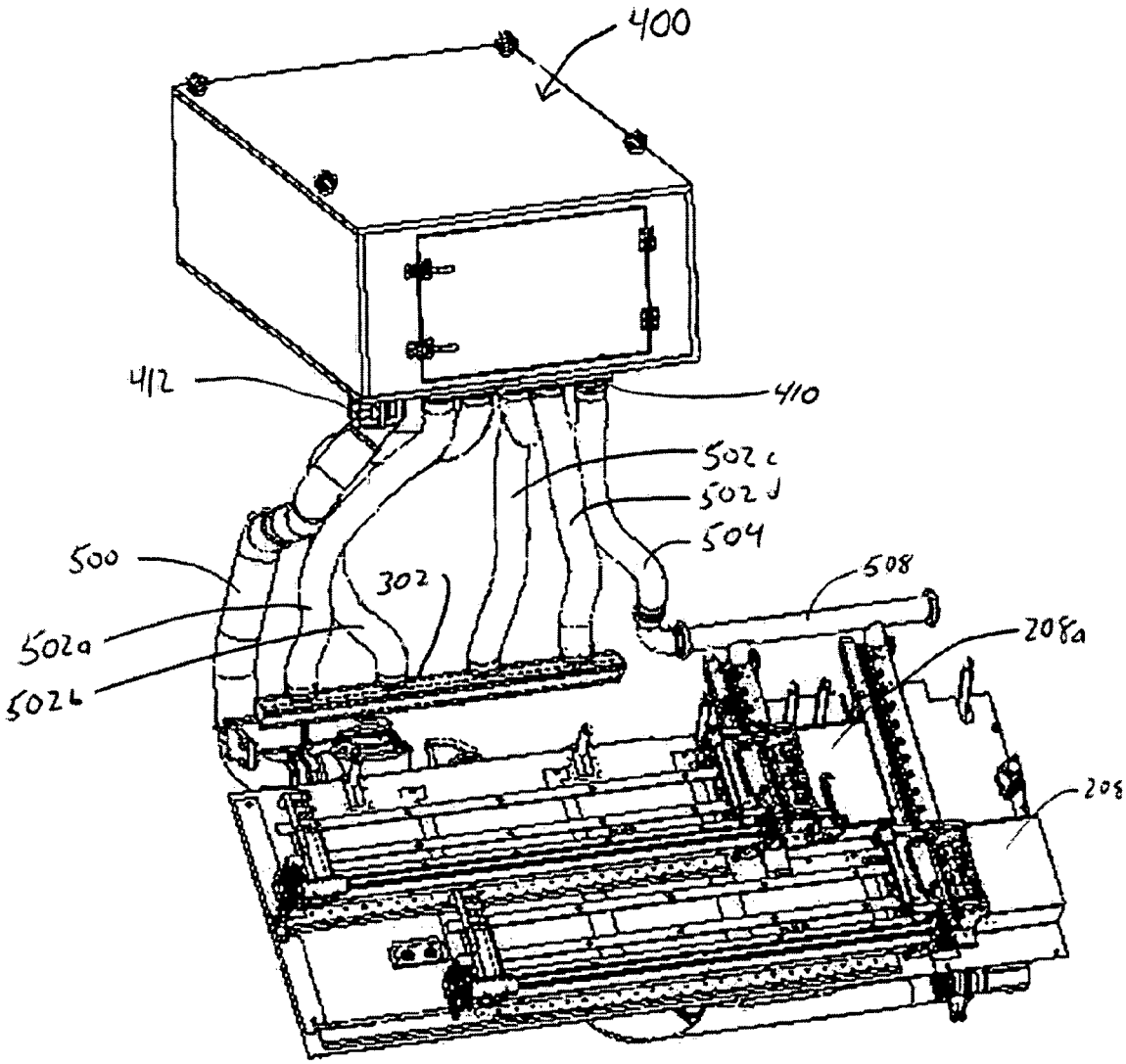
FIG. 5—is an isometric detail view of one embodiment of the air filtration unit plumbed to the carton magazine assembly.

FIG. 5 details one embodiment of the plumbing connecting the air filtration unit 400 and the carton magazine assembly 100. In this case, the exterior casing of the carton magazine assembly 100 and the magazine cover 104 and blank opening covers 110 are removed only to improve visualization. The air filtration unit 400 has a suction air inlet 412 that pulls air from the carton magazine assembly 100. The suction air inlet 412 is connected to a suction tube 500.

The air filtration unit 400 also has a conditioned air outlet manifold 410 that provides pressurized conditioned air to the carton magazine assembly 100. In this embodiment, the conditioned air outlet manifold 410 is connected to four conditioned air tubes 502*a*, 502*b*, 502*c*, and 502*d* which lead to the cover conditioned air inlet 302. A single conditioned air tube 504 is also connected to the conditioned air outlet manifold 410 and provides pressurized conditioned air to the blank opening conditioned air manifold 508. The blank opening conditioned air manifold 508 distributes the pressurized conditioned air to the carton opening mechanisms 208*a* and 208*b*.

Figure 6:
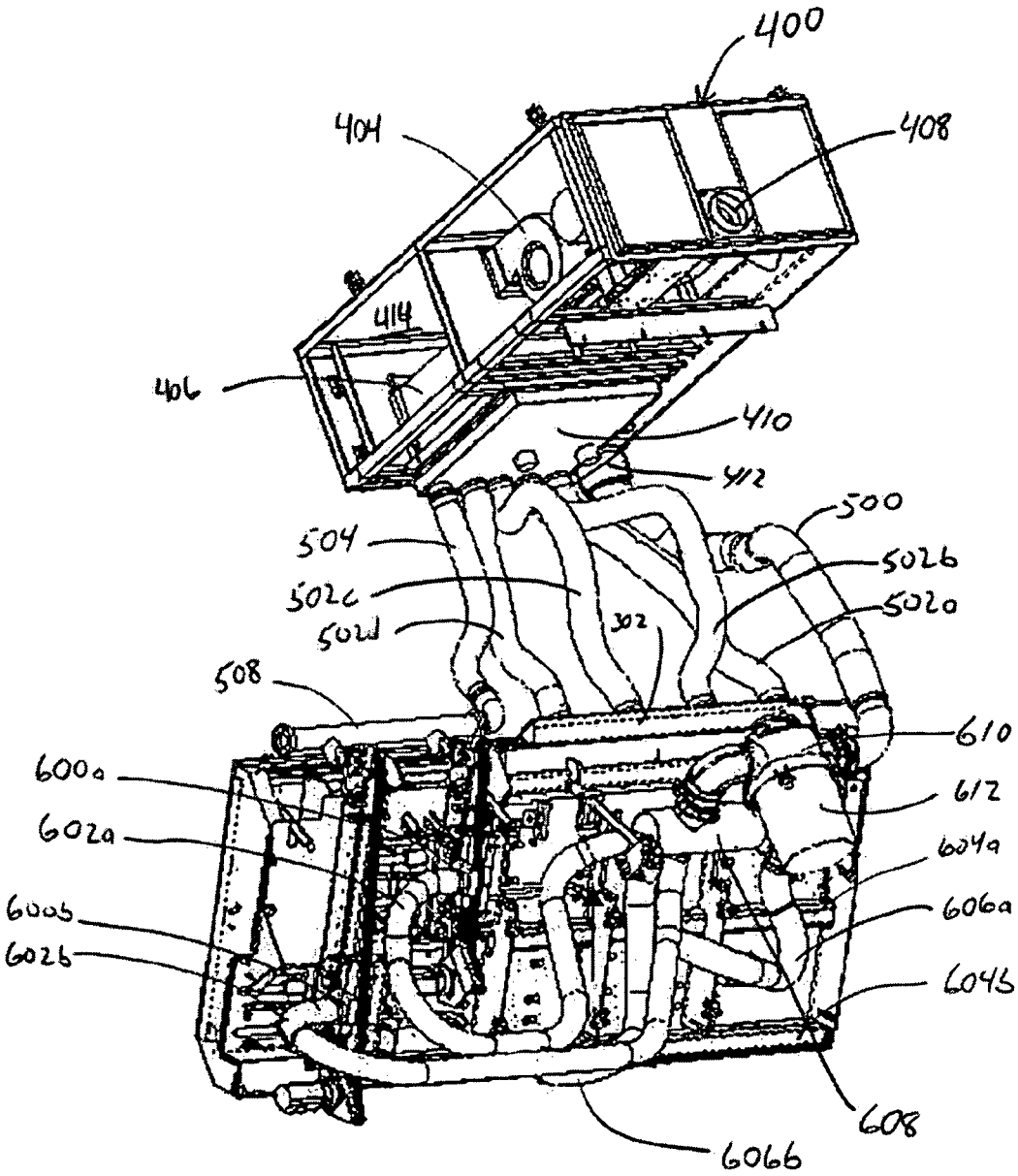
FIG. 6—is a view of the backside of carton magazine assembly with connections to the air filtration unit.

A view of the underside of the carton magazine assembly is shown in FIG. 6. In this figure, the air filtration unit 400 has side panels that normally enclose the unit removed for visualization purposes thereby exposing several internal components including the air conditioning staging volume 414, the air filter 406 and the air blower 404. There are two suction contaminant collectors 600*a* and 600*b* associated with the respective blank opening mechanisms 208*a* and 208*b*. The suction contaminant collectors 600 collect carton dust and other contaminants from inside the blank opening mechanisms 208. The dust is collected with the suction contaminant collectors 600 because the suction contaminant collectors 600 are held at a lower pressure than the pressure inside the carton magazine assembly 100 and the conditioned air expelled by the blank opening conditioned air manifold 508 is directed across the blank opening mechanisms 208 and toward the suction contaminant collectors 600.

Located underneath the magazine suction nozzles 214*a* and 214*b* are suction air manifolds 604*a* and 604*b*. The suction air manifolds 604 provide a region of low pressure, relative to the interior of the carton magazine assembly 100 or the outside environment, thereby urging air from within the carton magazine assembly 100 to flow into the magazine suction nozzles 214. Further, contaminants are collected with the magazine suction nozzles 214 because the magazine cover air manifold 212 directs air over the carton magazines 204 thereby urging contaminants toward the magazine suction nozzles 214 and the suction air manifolds 604. The suction air manifolds 604*a* and 604*b* are connected to respective flexible manifold suction tubes 606*a* and 606*b*.

The flexible manifold suction tubes 606 and the flexible suction hoses 602 come together at a single suction manifold 608. The suction manifold is plumbed into a suction filter canister 610. The suction filter canister 610 has a removable filter 612. The collected dust and air from the carton magazine assembly 100 is passed through the suction filter 610 and some contaminants are trapped in the removable filter 612 for disposal. The collected air with the remaining dust is then pulled through the suction tube 500, the suction air inlet 412, the rectangular suction tube 418, and the suction blower inlet 420 into the suction blower 402 to be exhausted from the system via the suction exhaust port 408.

The embodiment depicted in these figures show specific numbers of suction and conditioned air tubes connecting the air filtration unit 400 to the carton magazine assembly 100. The numbers and configuration of tubes can be modified and selected according to well defined parameters including, but not limited to, the desired pressure necessary to effectively remove contaminants, the pressure drop within the various tubes, filters, manifolds, and nozzles of the conditioned air system, the overall air volume, and other parameters known to those of ordinary skill in the art. In the embodiments depicted, the air filtration unit 400 is mounted above the carton magazine assembly 100. However, in alternative embodiments, the air filtration unit 300 is mounted in other locations including on the support frame 102. Further, the embodiments depicted show only two carton magazines 204 and two carton opening mechanisms 208. The teachings enclosed provide sufficient instruction for one of ordinary skill in the art to either increase or decrease the number of separate carton magazines 204 and carton opening mechanisms 208 as needed to service a specific packaging system 700.

Figure 7:
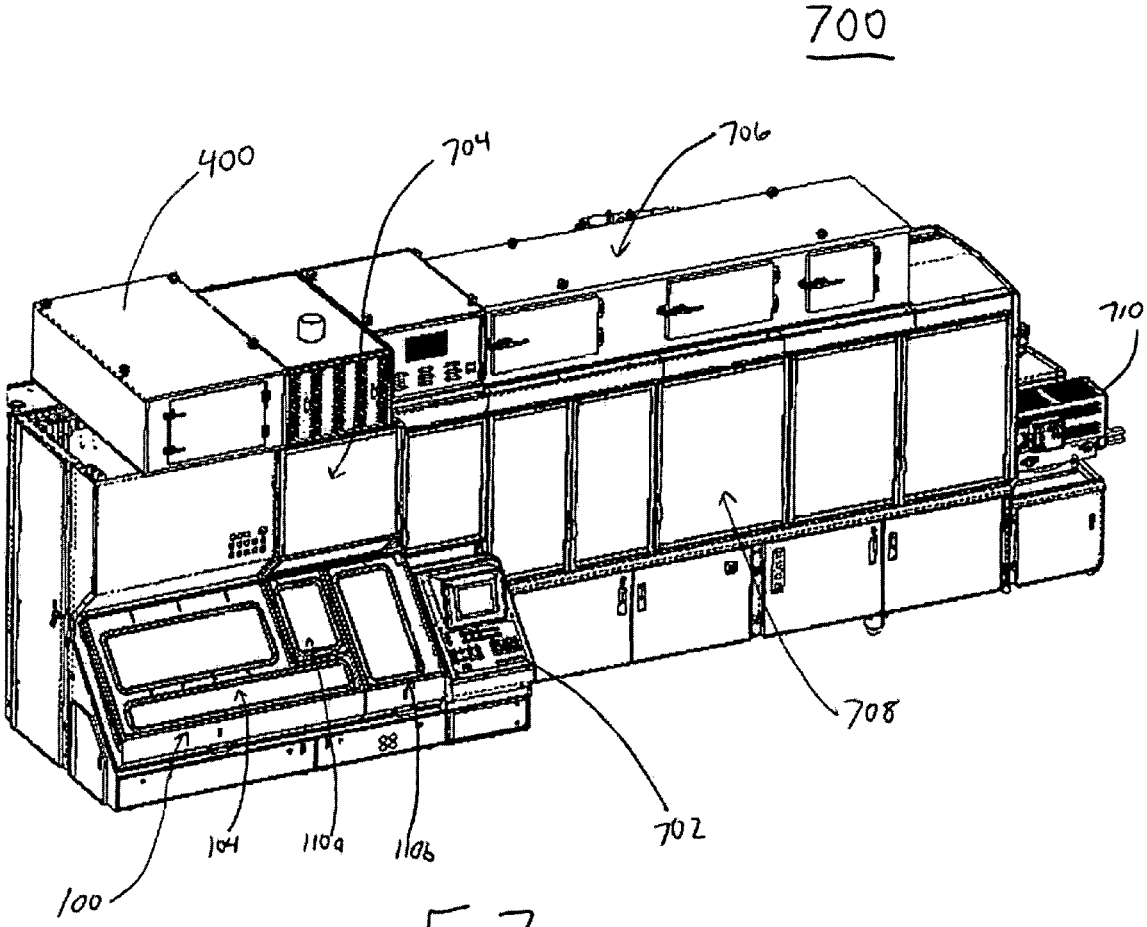
FIG. 7—is an isometric view of the packaging system.

An embodiment of an automated packaging system 700 incorporating a carton magazine assembly 100 as described above is shown in an isometric view in FIG. 7. The carton magazine assembly 100 is shown with the magazine cover 104 closed. The air filtration unit 400 for the carton magazine assembly 100 is shown mounted above the carton magazine assembly 100. Next to the carton magazine assembly 100 is the operator console 702. The operator monitors the status of the packaging system 700 at the operator console 702 and can use the operator interface systems at the operator console 702 to provide local commands for the packaging system 700. After the carton magazine assembly 100, the next station inside the packaging system is the carton blank folding and sealing station 704. The carton blank folding and sealing station 704 takes a carton blank that have been opened by carton opening mechanisms 208 and folds the carton to create, typically, a box like shape. The bottom is then sealed to create a fluid tight seal to contain the product.

After creating the lower portion of the carton, the folded and partially sealed carton is moved to the next station of the packaging system 700, the carton sanitization, filling, and top sealing station 708. At the carton sanitization, filling, and top sealing station 708 the carton is first sanitized to remove any last contaminants from the carton. Then the carton is filled with product to the desired level. After the sanitized carton is filled, the carton is then sealed to create a closed, filled product carton. The filled and sealed product cartons are then ejected from the machine at the filled container discharge point 710 for any additional packaging, bundling, post-processing and ultimately shipment. A second air filtration unit 706 provides HEPA microfiltered air to the carton blank folding and sealing station 704, the carton sanitization, filling, and top sealing station 708, and the remainder of the environmentally controlled packaging system 700.

The packaging system 700 is controlled by an electronic control system with a user interface provided at the operator console 702. The electronic control system is a digital computer control system. The digital computer control system may operate as a programmable logic controller (PLC) or other real-time controller. The digital computer control system accepts a variety of different inputs from sensors and command inputs to operate the system according to the programmed control logic. The different types of sensor inputs from the carton magazine assembly 100 can include, but are not limited to, carton magazine 204 fill levels, carton opening mechanism 208 status, suction filter 210 status, air conditioning staging volume pressure 414, carton magazine assembly 100 internal pressure, suction air inlet air velocity 412, conditioned air outlet air velocity 410, carton opening conditioned air manifold 506 pressure or air velocity, magazine cover air manifold 212 pressure, electric motor 422 and/or single electric motor 424 operation status, voltage, and temperature, and other sensor inputs identifiable to those of ordinary skill in the art. The command inputs can include, but are not limited to, commands such as start, stop, and operate. The digital computer control system may record information gathered from sensors and record commands given during operations for diagnostic and other reporting requirements. The recorded information can be either stored locally on the controller or forwarded via a network to an external database (not shown). In alternative embodiments, the control of the packaging system 700 is performed with discrete electronic components, electo-mechanical components, hydraulic or pneumatic couplings or other combinations thereof as known to those of ordinary skill in the art.

The embodiments of the invention shown in the drawings and described above are exemplary of numerous embodiments that may be made within the scope of the appended claims. It is contemplated that numerous other configurations of carton magazine assemblies 100 and associated air filtration units 400 and packaging systems 700 may be created taking advantage of the disclosed approach. It is the applicant's intention that the scope of the patent issuing herefrom will be limited only by the scope of the appended claims.

What is claimed is:

1. A carton magazine assembly, comprising:

a paper carton magazine attached to the carton magazine assembly configured to accept a stack of paper carton blanks;

a magazine cover with an interior surface and an exterior surface, including a viewing window, rotatably attached to the paper carton magazine assembly with a closed position such that said magazine cover encloses said carton magazine, and an open position; and a magazine cover air manifold formed on said interior surface with an air inlet, including a transparent perforated air cover offset from said interior surface.

2. A carton magazine assembly of claim 1, wherein said magazine cover air manifold is filled with conditioned air at a higher pressure than the air inside the carton magazine assembly.

3. A carton magazine assembly of claim 2, wherein said magazine cover air manifold substantially directs said conditioned air toward said carton magazine.

4. A carton magazine assembly of claim 3, further comprising a magazine suction nozzle disposed adjacent to said carton magazine to remove air from the inside of the carton magazine assembly.

5. A carton magazine assembly of claim 1, wherein said magazine cover air manifold is filled through said air inlet with conditioned air.

6. A carton magazine assembly of claim 5, wherein said perforated air cover substantially directs the flow of said conditioned air toward said carton magazine.

7. A carton magazine assembly of claim 6, wherein said conditioned air is microfiltered air.

8. A carton magazine assembly of claim 6, further comprising a magazine suction nozzle mounted adjacent to said carton magazine.

9. A carton magazine assembly of claim 1, further comprising air springs attached to said magazine cover to assist rotating said magazine cover from said closed position to said open position.

10. A carton magazine assembly of claim 1, further comprising a blank opening mechanism associated with said carton magazine to open carton blanks stored in said carton magazine.

11. A carton magazine assembly of claim 10, further comprising a blank opening mechanism cover with an interior surface and an exterior surface, rotatably attached to the carton magazine assembly with a closed position such that said blank opening mechanism cover encloses said blank opening mechanism and an open position.

12. The carton magazine assembly according to claim 1 the magazine cover air manifold includes a plurality of holes that direct and distribute air onto the paper carton magazine.

13. The carton magazine assembly according to claim 1, wherein the magazine cover includes a seal that is not air tight, for enclosing an interior volume of said carton magazine assembly.

14. A carton magazine assembly, comprising:

an air filtration unit delivering conditioned air to a paper carton magazine of the carton magazine assembly, and removing air from the carton magazine assembly;

a carton magazine attached to the carton magazine assembly capable of accepting paper carton blanks;

a blank opening mechanism associated with said carton magazine to open carton blanks stored in said carton magazine, a magazine cover with an interior surface and an exterior surface, rotatably attached to the carton magazine assembly with a closed position such that said magazine cover encloses said carton magazine and an open position;

a magazine cover air manifold formed on said interior surface capable of accepting said conditioned air; and a suction port adjacent to said carton magazine, in fluid connection with said air filtration unit for directing the removal of air from the carton magazine assembly.

15. A carton magazine assembly of claim 14, wherein said air filtration unit delivers said conditioned air to the carton magazine assembly via a conditioned air tube and removes said air from the carton magazine assembly via a suction tube.

16. A carton magazine assembly of claim 14, wherein said magazine cover air manifold is formed between the interior surface and a perforated air cover offset from said interior surface, and wherein said magazine cover air manifold directs said conditioned air toward said carton magazine.

17. A carton magazine assembly, comprising:

a magazine cover with an interior and exterior surface, and including a seal that is not air tight, for enclosing said carton magazine assembly to create an interior volume;

a paper carton magazine in said interior volume capable of accepting a stack of paper carton blanks;

a means for opening said magazine cover to access said interior volume and said carton magazine;

a blank opening cover enclosing a second part of said carton magazine assembly to create a second interior volume;

a blank opening mechanism in said second interior volume;

a means for opening said blank opening cover to access said second interior volume and said blank opening mechanism;

a first blower means of blowing conditioned air into said interior volume over said carton magazine;

a means of blowing conditioned air into said second interior volume over said blank opening mechanism;

a second blower means of removing air from said interior volume; a means of removing air from said second interior volume.

18. A carton magazine assembly of claim 17, whereby said means of blowing conditioned air directs said conditioned air from said interior surface over said carton magazine.

19. A carton magazine assembly of claim 18, whereby said means of removing air from said interior volume is disposed along the path of said conditioned air after said conditioned air passes over said carton magazine.

* * * * *

UNITED STATES PATENT AND TRADEMARK OFFICE

CERTIFICATE OF CORRECTION

PATENT NO. : 7,665,727 B2
APPLICATION NO. : 11/304832
DATED : February 23, 2010
INVENTOR(S) : Gerald Paul Berger et al.

It is certified that error appears in the above-identified patent and that said Letters Patent is hereby corrected as shown below:

On the Title Page, in Item (57), in Abstract, in column 2, line 1, delete "of for" and insert -- for --, therefor.

In column 2, line 60, delete "electro-rheologic" and insert -- electro-rheological --, therefor.

In column 4, line 50, delete "(polymethlamethacrylate)," and insert -- (polymethylmethacrylate), --, therefor.

In column 4, line 51, delete "terphthalate)," and insert -- terephthalate), --, therefor.

In column 4, line 52, delete "(polymethylpenten)," and insert -- (polymethylpentene), --, therefor.

In column 8, line 5, delete "electo-mechanical" and insert -- electro-mechanical --, therefor.

In column 9, line 16, in Claim 14, delete "magazine," and insert -- magazine; --, therefor.

In column 10, line 24, in Claim 17, after "volume;" insert -- and --.

Signed and Sealed this
Twenty-ninth Day of May, 2012

David J. Kappos

David J. Kappos
*Director of the United States Patent and Trademark Office*